US005615434A

United States Patent [19]

Cracchiolo et al.

[11] Patent Number: 5,615,434

[45] Date of Patent: Apr. 1, 1997

[54] VIEWING STRUCTURE FOR INFANTS

[76] Inventors: James M. Cracchiolo; Justina M. Cracchiolo, both of 5212 Golf Links Blvd., Zephyrhills, Fla. 33541

[21] Appl. No.: 497,110

[22] Filed: Jun. 30, 1995

[51] Int. Cl.[6] ..... A47C 31/00

[52] U.S. Cl. ..... 5/658; 5/93.1; 5/503.1; 5/507.1; 108/49

[58] Field of Search ..... 5/93.1, 507.1, 5/503, 658; 108/49, 42, 184

[56] References Cited

U.S. PATENT DOCUMENTS

| | | | |
|---|---|---|---|
| Re. 24,845 | 7/1960 | Heffernan . | |
| 2,461,682 | 2/1949 | De Ferrari . | |
| 2,493,401 | 8/1947 | Gounter | 5/93.1 |
| 2,699,794 | 1/1955 | Potter . | |
| 3,165,760 | 1/1965 | Abajian . | |
| 3,894,304 | 7/1975 | Burbidge et al. | 5/93.1 |
| 4,465,255 | 8/1984 | Hill | 5/503.1 |

FOREIGN PATENT DOCUMENTS 666310 7/1963 Canada .

*Primary Examiner*—Steven N. Meyers
*Assistant Examiner*—Fredrick Conley
*Attorney, Agent, or Firm*—Merrill N. Johnson

[57] ABSTRACT

A structure for attachment to an infant crib for supporting objects to be viewed by an infant in the crib. The structure includes a rectangular crystal-clear flexible sheet sized to fit over a portion of the infant crib. The four edges of the sheet are each folded over and sewn to the sheet to form an elongated tube. A dowel rod somewhat longer than the tube is inserted through each of the four tubular edges of the sheet. Each of the adjacent ends of two dowel rods are inserted into a cubical block. Each of the four cubical blocks supports a length of cord for securing the structure to the infant crib.

4 Claims, 1 Drawing Sheet

FIG. 1
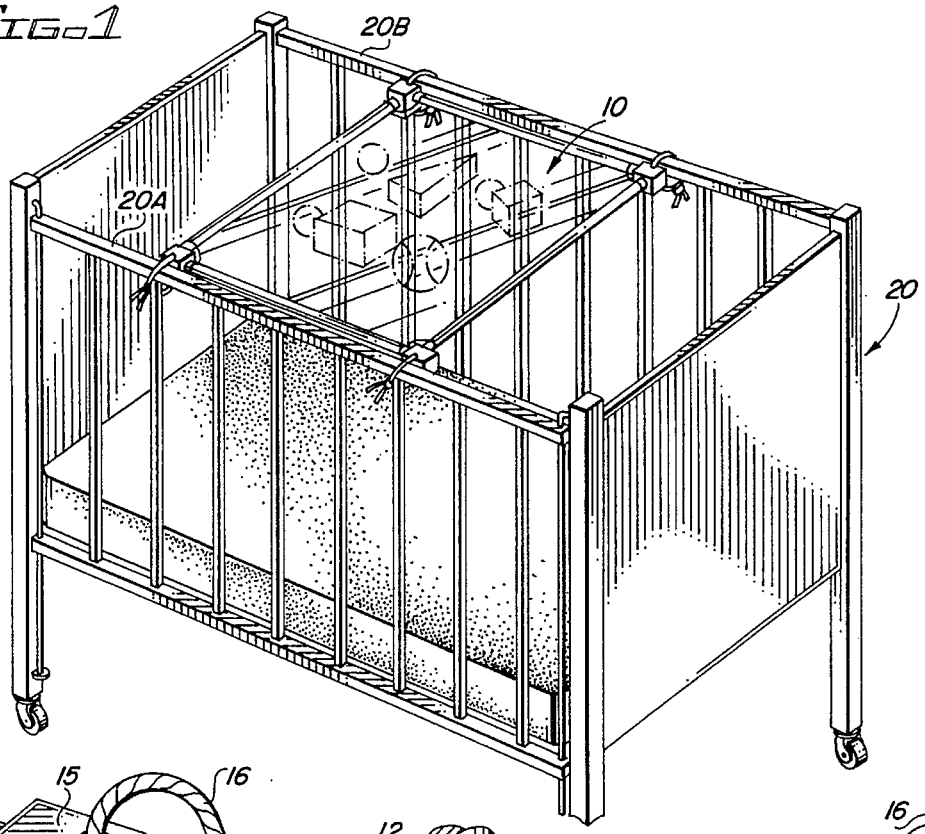
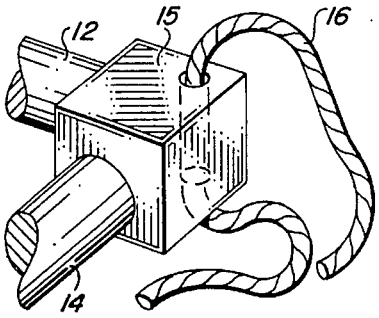
FIG. 2
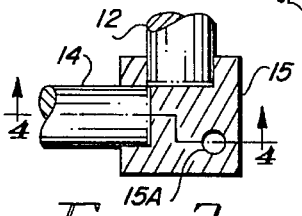
FIG. 3
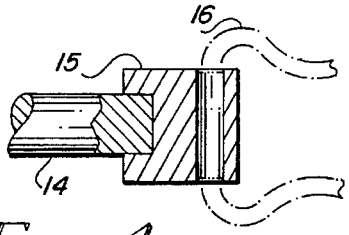
FIG. 4
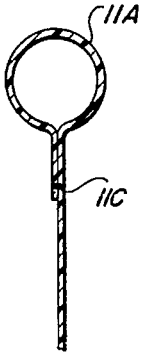
FIG. 6
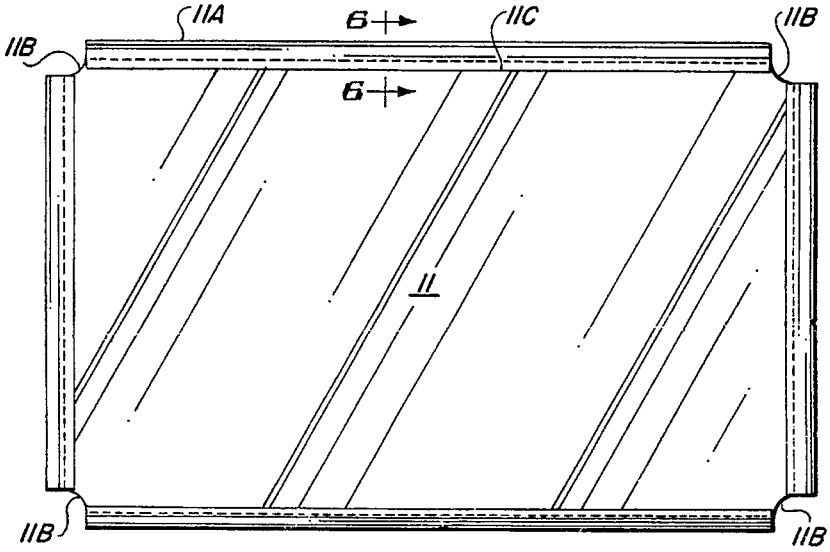
FIG. 5

VIEWING STRUCTURE FOR INFANTS

FIELD OF THE INVENTION

Our invention lies in the field of infant education and more particularly a structure used to entertain and increase the visual perception of an infant lying in a crib.

BACKGROUND OF THE INVENTION

The practice of suspending brightly colored mobiles, balloons or toys over a baby crib to entertain an infant in the crib is well known.

Recent scientific research indicates that exposure of an infant to frequently changing visual stimuli from birth to three or more months will enhance the child's brain-cell development, stimulate the infant's visual perception, increase the child's attention span, and entertain the child for considerable periods of time without continuous adult supervision.

During the first six months of his or her life, an infant spends a lot of its time lying in a crib. For the infant to observe and be stimulated by brightly colored objects, the objects must be suspended from the ceiling of the nursery directly over the infant's crib. This method of exposing the infant to stimulating objects requires considerable effort and does not lend itself to frequent changes of the objects to be viewed by the infant.

BRIEF DESCRIPTION OF THE INVENTION

We have invented a structure which can be easily suspended over a conventional infant's crib onto which can be placed various infant stimulating objects such as brightly colored toys, family photographs, blocks bearing letters or numerals and two dimensional designs to be viewed by the infant lying on its back in the crib.

We found that our week old son's initial span or period of concentration, that is, the period during which he remained interested in the display of objects within his viewing area, would last about five to ten minutes and then upon changing the objects to be viewed, he would again exhibit a keen interest in the objects above him for about five to ten minutes.

As we continued this viewing process at least four days each week for five months, the infant's period of interest in the stimulating objects increased from between five to ten minutes to between fifteen to thirty minutes.

Briefly stated, our invention provides a transparent viewing tray upon which to place objects to be viewed by an infant in a crib. The structure includes a rectangular sheet of crystal-clear transparent flexible material, preferably vinyl plastic, sized to fit over a portion of a conventional infant crib.

The four edges of the sheet are folded over and each edge sewn or otherwise secured to the sheet to form four tubular edges. A member such as a wooden pole somewhat longer than the tubular edge of the sheet is inserted through each tubular edge of the sheet and the member's two ends are each inserted into a cubical block. By means such as a length of flexible cord attached to each of the four blocks, the structure is removably affixed preferably to the top rail of the two sides of the infant crib directly above the infant's head to provide a viewing area for objects to be placed upon the transparent sheet.

BRIEF DESCRIPTION OF THE DRAWINGS

The appended drawings illustrate a preferred form of our invention but are not intended to limit the scope of our invention.

FIG. 1 is a perspective view of our infant viewing structure mounted on a conventional infant crib.

FIG. 2 is a detailed view partially cut away of one of the four blocks shown in FIG. 1.

FIG. 3 is a detailed view partially in cross section showing the ends of two rods affixed to the block shown in FIGS. 1 and 2.

FIG. 4 is a detailed view partially in cross section taken along line 4—4 of FIG. 3.

FIG. 5 is a plan view taken from above of the transparent tray of our infant viewing structure shown by itself.

FIG. 6 is a cross sectional view of the tubular edge of the transparent tray taken along line 6—6 of FIG. 5.

DESCRIPTION OF THE PREFERRED EMBODIMENT

FIG. 1 of the appended drawings illustrates a preferred form of our viewing structure 10 mounted on a typical infant crib 20 with an assortment of colorful articles displayed on the upper surface of tray 11 of viewing structure 10. Because the displayed articles form no part of our invention, they are shown in dotted lines.

Viewing structure 10 comprises tray 11 made of a flexible preferably crystal-clear vinyl plastic material as best shown in FIG. 5, four elongated members 12 and 14, four preferably cubical blocks 15, and four lengths of flexible preferably cord 16 used to secure viewing structure 10 to the top rails 20A and 20B of the sides of crib 20 as shown in FIG. 1.

Tray 11 is made from a sheet of flexible crystal-clear vinyl whose four corners 11B are cut out as shown in FIG. 5 and each of its four edges are folded over and sewn or otherwise bonded as designated at 11C to the sheet to form tubular edges 11A as shown in cross section in FIG. 6.

Two pairs of dowel rods 12 and 14 are inserted through the four tubular edges 11A of tray 11. Each rod is sized somewhat longer than the length of the tubular edge through which the rod is inserted.

Four identical preferably cubical blocks 15 are drilled to provide two identical cylindrical recesses whose centerlines if continued would intersect with an interior angle of 90° and a cylindrical hole, all as shown in FIGS. 2, 3 and 4. The recesses are sized to receive an end of rods 12 and 15 which by glue or other means are affixed into blocks 15.

A length of flexible cord 16 is passed though the holes in each of the four blocks 15 to secure viewing structure 10 to the upper rails 20A and 20B of crib 20 as shown in FIG. 1.

While we have shown and described a preferred embodiment of our viewing structure and its use such description should in no way be construed as limiting the scope and spirit of our invention whose scope is defined only by the appended claims.

We claim:

1. A structure for attachment to an infant crib to support objects to be viewed by and to stimulate an infant in the crib comprising a rectangular sheet of transparent flexible material sized to fit over a portion of an infant crib to receive on its upper surface assorted infant stimulating objects, the rectangular sheet having each of its four edges folded over and bonded to the sheet to form an elongated tube, a member somewhat longer than the aforesaid elongated tube inserted through each one of the four tubular edges of the sheet of transparent material, four generally cubical blocks, each having two holes sized to receive the ends of two of the aforesaid members and also having a third hole through a corner of the block, and a length of flexible material passing through the third hole in each of the four blocks sized to secure the structure to the infant crib.

2. A structure for attachment to an infant crib as set forth in claim 1 in which the rectangular sheet is made of transparent crystal-clear vinyl material.

3. A structure for attachment to an infant crib as set forth in claim 1 in which each member is a cylindrical rod.

4. A structure for attachment to an infant crib as set forth in claim 1 in which the flexible members are cords.

* * * * *